US009970461B2

(12) United States Patent
Nawrocki et al.

(10) Patent No.: US 9,970,461 B2
(45) Date of Patent: May 15, 2018

(54) COMPRESSOR UNIT WITH A VARIABLE AERODYNAMIC PROFILE

(71) Applicant: Thermodyn Sas, Le Cruesot (FR)

(72) Inventors: Gilles Nawrocki, Le Creusot (FR); Pascal Gaudez, Le Cruesot (FR)

(73) Assignee: Thermodyn SAS, Le Creusot (FR)

( * ) Notice: Subject to any disclaimer, the term of this patent is extended or adjusted under 35 U.S.C. 154(b) by 193 days.

(21) Appl. No.: 14/760,556

(22) PCT Filed: Jan. 13, 2014

(86) PCT No.: PCT/EP2014/050428

§ 371 (c)(1),
(2) Date: Jul. 13, 2015

(87) PCT Pub. No.: WO2014/108523

PCT Pub. Date: Jul. 17, 2014

(65) Prior Publication Data

US 2015/0354599 A1 Dec. 10, 2015

(30) Foreign Application Priority Data

Jan. 14, 2013 (FR) ..... 13 50304

(51) Int. Cl.
*F04D 29/46* (2006.01)
*F04D 29/66* (2006.01)
(Continued)

(52) U.S. Cl.
CPC ..... *F04D 29/667* (2013.01); *F04D 17/10* (2013.01); *F04D 17/122* (2013.01); *F04D 25/02* (2013.01);
(Continued)

(58) Field of Classification Search
CPC ..... F04D 29/46; F04D 29/462; F04D 29/464; F04D 29/466; F04D 29/468
See application file for complete search history.

(56) References Cited

U.S. PATENT DOCUMENTS 2,300,766 A * 11/1942 Baumann ..... F04D 29/462 415/149.1
3,461,685 A 8/1969 Hoffman et al.
(Continued)

FOREIGN PATENT DOCUMENTS

DE 2403113 A 8/1975
DE 2403113 A1 * 8/1975 ..... F04D 29/46
(Continued)

OTHER PUBLICATIONS

JP 61135998 A Machine Translation. Accessed JPO website Apr. 11, 2017. 3 pages.*
(Continued)

*Primary Examiner* — Richard Edgar
(74) *Attorney, Agent, or Firm* — GE Global Patent Operation

(57) ABSTRACT

A compressor unit is disclosed comprising at least a first motor driving in rotation at least one impeller of a compression stage, having at the outlet of the impeller a diffuser designed to centrifugally channel the gases coming from the impeller, and having a centripetal return channel downstream of the diffuser. The return channel includes at least one movable blade portion that, when moved, can vary a tangential component of the speed of the gases coming from the return channel.

22 Claims, 2 Drawing Sheets

(51) Int. Cl.

| | |
|---|---|
| ***F04D 17/10*** | (2006.01) |
| ***F04D 25/02*** | (2006.01) |
| ***F04D 29/44*** | (2006.01) |
| ***F04D 29/28*** | (2006.01) |
| ***F04D 17/12*** | (2006.01) |
| ***F04D 27/02*** | (2006.01) |

(52) U.S. Cl.
CPC ..... *F04D 27/0246* (2013.01); *F04D 29/284* (2013.01); *F04D 29/444* (2013.01); *F04D 29/462* (2013.01)

(56) References Cited

U.S. PATENT DOCUMENTS

| | | | |
|---|---|---|---|
| 3,853,433 | A | 12/1974 | Roberts et al. |
| 2011/0135441 | A1 | 6/2011 | Sorokes et al. |

FOREIGN PATENT DOCUMENTS

| | | | | | |
|---|---|---|---|---|---|
| FR | 1061391 | A | | 4/1954 | |
| GB | 205112 | A | * | 1/1924 | ..... F04D 29/462 |
| JP | S54-78011 | U | | 6/1979 | |
| JP | S5672300 | A | | 6/1981 | |
| JP | 61135998 | A | * | 6/1986 | |
| JP | H08200289 | A | | 8/1996 | |
| JP | 2001200797 | A | | 7/2001 | |
| JP | 2009264305 | A | * | 11/2009 | ..... F04D 29/462 |
| JP | 2011043130 | A | | 3/2011 | |
| SU | 1101591 | A1 | | 7/1984 | |
| SU | 1250732 | A1 | | 8/1986 | |

OTHER PUBLICATIONS

International Search Report and Written Opinion issued in connection with corresponding WO application PCT/EP2014/050428 dated May 12, 2014.

Office Action and Search issued in connection with corresponding RU Application No. 2015128278 dated Nov. 16, 2017.

Notification of Reasons for Refusal issued in connection with corresponding JP Application No. 2015-552061 dated Nov. 28, 2017.

* cited by examiner

COMPRESSOR UNIT WITH A VARIABLE AERODYNAMIC PROFILE

BACKGROUND

Embodiments of the present invention relate to centrifugal compressor units and, more specifically, built-in centrifugal compressor units, in which the compressor and motor drive means of the compressor are assembled in a shared housing sealed against the gas handled by the compressor.

A conventional built-in compressor unit includes motor means, generally comprising an electric drive motor and a centrifugal compressor with one or more compression stages.

Each compression stage includes an impeller mounted on a driven shaft coupled to the rotor of a drive motor.

In certain applications, and in particular for low-pressure applications, the use of variable-pitch impellers has been proposed to modify the work done by the compression stage as a function of the gas flow rate. This makes it possible to keep the work of the compressor constant for a wider range of gas flow rates. Patent application FR 1061391 thus proposes placing the variable-pitch impellers both upstream of a compressor impeller and in a diffuser of a compressor stage.

Mechanical devices can be used to modify the orientation of the blades, for example by fitting a group of blades with a ring gear driven by a worm gear device, or by fitting each blade with direct drive means dedicated to that blade.

A motor is then used to actuate the mechanical device for controlling orientation of the blades.

The movable blades thus inserted in the gas flow are subject to considerable deflection stresses in relation to the axis of rotation thereof, and significant torque is required to orient each blade. The blades and the drive system thereof need to be dimensioned accordingly. Adding the movable-blade system therefore represents a cost that should ideally be reduced, said cost being even greater if the compressor has several stages.

SUMMARY OF INVENTION

Embodiments of the invention overcome these drawbacks, in particular for a compressor with several stages, by proposing a built-in compressor unit with a variable aerodynamic profile, implementation of which requires smaller movable elements that are cheaper to make, while providing at least equally large operating ranges.

An embodiment of the invention proposes a compressor unit comprising at least a first motor driving in rotation at least one impeller of a compression stage. At the outlet of the impeller, the compressor unit includes a diffuser portion designed to centrifugally channel the gases coming from the impeller, and a centripetal return channel downstream of the diffuser. The return channel includes at least one movable blade portion that, when moved, can vary a tangential component of the speed of the gases coming from the return channel. In this case, centrifugal movement or device means a movement or a device tending to move the gases away from the axis of the impeller. In this case, centripetal movement or device means a movement or a device tending to move the gases towards the axis of the impeller. Tangential component of the speed of the gases at a given point means the component of this speed that is tangential to the circle centered on the axis of the impeller and passing through this point. The compressor may include several compression stages, and at least one impeller for each compression stage.

The return channel is a duct portion designed to carry the gases towards the geometric axis of the impeller, from an annular inlet of the return channel corresponding to the outlet of the centrifugal diffuser. The return channel has a geometry that is periodic by rotation about the axis of the impeller. The envelope of the return channel may be defined by two surfaces of revolution about the axis of the impeller.

The return channel may for example include a volume between two disc-shaped parallel faces, or between one disc-shaped face and one frusto-conical face, or between two frusto-conical faces.

According to an embodiment, the return channel has fixed blades, the movable blade portion being an extension of a fixed blade. In an embodiment, the movable blade portion is an extension of a fixed blade, located downstream of the fixed blade. According to another alternative embodiment, the return channel includes a group of fixed blades, each fixed blade in the group being preceded by a first movable blade portion that is an upstream extension of the fixed blade, and being followed by a second movable blade portion that is a downstream extension of the fixed blade.

According to another alternative embodiment, the movable blade portion may be an extension of another movable blade portion. In this case, the term blade portion is used because, since the blade portion is an extension of another blade portion, the two blade portions, one being an extension of the other, can be considered to form a single variable-geometry blade. Each portion could also be considered to be a separate blade, without affecting the content of the invention. An "extension" means that the deflecting surface of one of the two blades, or of the two blade portions, is substantially an extension of the other, such that throughout the gas flow, the gas is deflected by one of the blades or blade portions, then by the other blade or blade portion.

According to an embodiment, the return channel includes a movable blade portion extending from each fixed blade in the return channel. According to an embodiment, each movable blade portion is downstream of a fixed blade. According to another alternative embodiment, each movable blade portion is upstream of a fixed blade. According to an embodiment, the return channel includes a first group of angularly equidistant fixed blades set at the same radial distance from the geometric axis of the impeller, and a movable blade portion extending from each fixed blade of the first group. According to another embodiment, the return channel includes a first group of angularly equidistant fixed blades set at the same radial distance from the axis of the impeller, and a movable blade portion extending from only some of the fixed blades of the first group, the movable blade portions being angularly equidistant from one another. The number of movable blade portions is, in an embodiment, even, for example between 18 and 22. There may for example be 16, 18, 20 or 22 movable blades.

In an embodiment, the movable blade portion is movable in rotation in relation to an axis substantially parallel to the geometric axis of the impeller.

According to an embodiment, the return channel has several movable blade portions that are able to simultaneously adopt a neutral angular position for which the gases coming from the return channel have a substantially zero tangential speed component.

Each movable blade portion may then be able to turn between two extreme positions on either side of the neutral angular position. According to an embodiment, the extreme positions are separated from one another by an angular gap of between 10° and 60°, and more particularly between 20° and 40°. The angular gap may for example be around 30°.

In an embodiment, the axial width of the movable blade portion or portions is substantially equal to the axial width of the return channel.

The return channel may include several movable blade portions that can be moved by a single control motor. The movable blade portions can for example be linked to a single actuating ring gear moved via a worm gear by the control motor.

According to another alternative embodiment, the return channel includes a group of fixed blades, a first group of movable blade portions located upstream as extensions of the fixed blades, and a second group of movable blade portions located downstream as extensions of the fixed blades. According to another variant, some of the fixed blades can be fitted with movable blade portions located downstream of the fixed blades as extensions thereof, and other fixed blades in the first group can be fitted with movable blade portions located upstream of the fixed blades as extensions thereof.

In an embodiment, the group of first movable blade portions is able to turn on either side of a first neutral angular position, and, in an embodiment, the group of second movable blade portions is able to turn on either side of a second neutral angular position, both groups being able to turn independently of one another. When both groups of movable blade portions are placed in the respective neutral positions thereof, the tangential speed component of the gases coming from the return channel is substantially zero.

According to an alternative embodiment, the compressor unit may include several centrifugal compression stages, with at least two of the centrifugal compression stages each having one impeller, one diffuser portion and one return channel provided with movable blade portions. These movable blade portions can naturally be associated with the fixed blade portions of the return channel.

According to an embodiment, the set formed by the first motor, the impeller, the diffuser portion, the return channel and the control motor is assembled in a shared housing sealed against the gas handled by the compression unit. In an embodiment, the first motor and at least a part of the impeller are subject to substantially the same gas pressure, or in other words the first motor is immersed in the same gaseous volume as the area downstream of the impeller. This arrangement obviates sealing problems between a housing containing the first motor and a separate housing containing the compression stage, including the impeller. If the compressor includes several compression stages, the first motor is subject to substantially the same gas pressure as one of the compressor impellers, located close to the motor. The compressor may include several drive motors to drive several compression-stage impellers. All of these drive motors are then in a shared housing, and each is at substantially the same gas pressure as the inlet or outlet of one of the impellers of the compressor. There may then be a group of movable blades in the return channel of each of the compression stages. According to an alternative embodiment, there may be a group of movable blades in the return channel or channels of the compression stage or stages located downstream of the compressor.

The compressor unit may also include an electronic control unit outside the housing that is connected to the control motor using power-supply and control cables passing through the housing via sealed cable runs.

BRIEF DESCRIPTION OF THE DRAWINGS

Other objectives, features and advantages of the invention are set out in the description below, given purely by way of non-limiting example and in reference to the attached drawings, in which.

DETAILED DESCRIPTION

Figure 1:
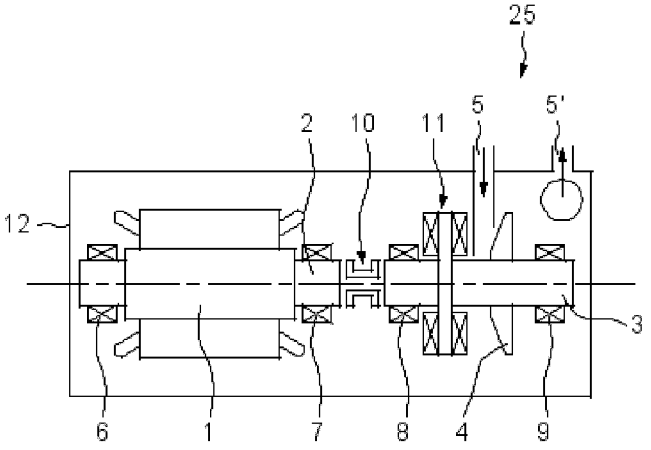
FIG. 1 is a schematic view of the general architecture of a single-stage compressor unit.

The compressor unit 25 shown in FIG. 1 includes a drive motor 1, comprising for example a variable-speed electric motor driving in rotation a rotor 2, itself driving, at an identical speed, a driven shaft 3 upon which are assembled one or more impellers 4.

In the example shown, the compressor unit has only one compression stage, comprising the centrifugal impeller 4 that sucks in a gas delivered from a delivery duct 5 to increase the pressure thereof and deliver it to an outlet 5'. According to alternative embodiments, the compressor unit may include several stages, a downstream outlet of an impeller communicating with the delivery duct of the following impeller. The impellers may be driven by one or more drive motors.

In the example embodiment shown, the rotor 2 of the motor 1 is held by two end bearings 6 and 7. The driven shaft 3 is also held by two end bearings 8 and 9. The rotor 2 and the driven shaft 3 are linked here by a flexible coupling 10. The rotor and the driven shaft may be linked by a fixed coupling without thereby moving outside the scope of the invention. In this case, one of the bearings, for example bearing 7 or bearing 8, may be omitted.

The compressor unit may have a stop 11 for limiting the axial movement of the driven shaft 3 under the action of the rotation of the impeller 4.

According to an embodiment, the drive motor 1 and the compression stage including the impeller 4 are arranged in a shared housing 12 sealed against the gas handled by the compressor. The drive motor 1 is at the pressure corresponding to the gas admission pressure to the impeller 4 or at the gas output pressure from the impeller 4, depending on the position thereof in relation to the impeller 4. In FIG. 1, the motor 1 being located on the axial side upstream of the impeller 4, the motor 1 is here at the suction pressure of the compressor unit. The motor may also be at the output pressure of the impeller 4 in an alternative embodiment in which the motor is on the axial side downstream of the impeller 4. Upstream or downstream means upstream or downstream of the compressor unit in relation to the overall direction of flow of the gases inside the compressor unit.

Figure 2:
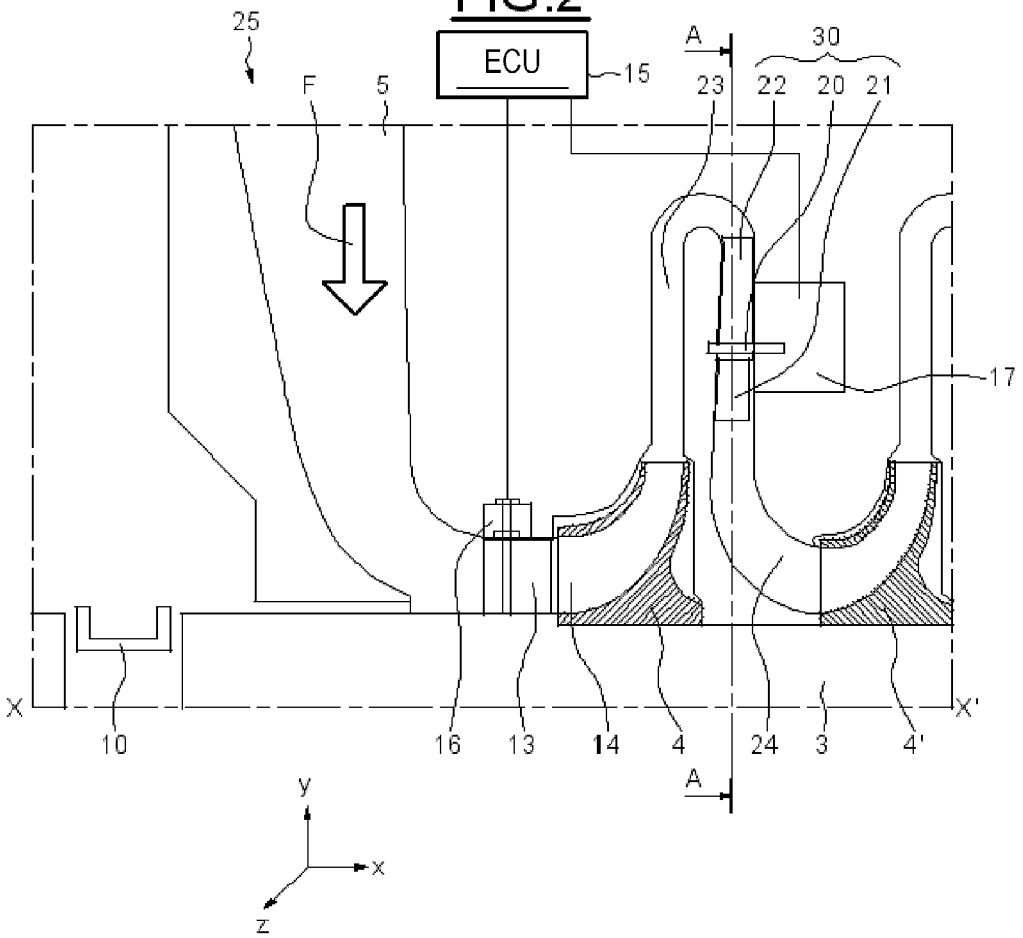
FIG. 2 is a detail of the compressor unit according to an embodiment of the invention.

FIG. 2 is a longitudinal cross section of a portion of a compressor unit according to an embodiment of the invention, corresponding to the general principle shown in FIG. 1. FIG. 2 includes elements shared with FIG. 1, the same elements being indicated using the same reference signs. The geometric axis XX', which corresponds to the geometric axis of the impeller 4, represents for several of the components of the compressor, either an axis of symmetry of rotation, or an axis about which the component has a periodicity by rotation. This is in particular the case for the diffuser 23 and the return channel 24.

FIG. 2 shows the gas admission orifice 5 through which the gas to be compressed is sucked in the direction of the arrow F, as well as the impeller 4 that compresses the gas before delivering it, downstream, to a diffuser 23 in which the gas is directed into a channel diverging radially by moving away from the geometric axis x of the impeller 4. The gas is thus slowed down, increasing the pressure thereof before it is outputted. The diffuser 23 is followed by a return channel 24 converging radially towards the geometric axis XX' of the impeller 4. The return channel can carry the gas to an outlet 5' of the diffuser, or, in the case of a multiple-stage compressor as shown in FIG. 2, towards the inlet of a second impeller 4', that is for example coaxial to the first impeller 4, and also located inside the sealed enclosure 12 of the compressor unit 25. The second impeller is part of a second compression stage (not shown in full in the figures), that may typically include a second return channel also fitted with a deflection device similar to the deflection device 30.

Upstream of the impeller 4, the compressor may be provided with an adjustment member, reference sign 13, comprising a group of movable blades interposed in a gas passage 14 extending between the admission orifice 5 and the impeller 4. This adjustment member is an aerodynamic element that enables the flow angle to be controlled and kept at an optimum value for a wide range of gas flows. The blades of the adjustment member 13 may be driven by a control motor 16, for example a step motor built into the compressor unit, i.e. placed inside the shared housing 12. The motor 16 is powered by electricity from outside the compressor unit and is controlled by an electronic control unit 15 that causes the rotation of the motor and the subsequent orientation of the blades of the member 13 in the passage 14 such as to move the operating curve of the compressor unit.

Naturally, the power-supply and control cables that link the control motor 16 and the central unit pass through the housing 12 via the runs (not shown) sealed against the gas handled by the compressor unit, such as to retain a seal that is better than the seal required through the mechanical devices in the prior art, when the motor is placed inside the housing.

The compressor unit 25 also includes a gas deflection member 30, placed in the return channel 24. According to alternative embodiments, the gas deflection device 30 can replace the adjustment member 13, or substitute itself for the adjustment member 13. The deflection device 30 includes a group of fixed blades 22, and a group of blades 21 each movable about a dedicated axis 20 and driven by a single second drive motor 17. Each movable blade 21 is substantially an extension of a fixed blade 22 downstream of the fixed blade 22, and is movable in rotation about an axis 20, which is substantially parallel to the axis XX' and located in the immediate proximity of the fixed blade 22, such that the gas flows channeled by a first and by a second face of the fixed blade 22 continue to be channeled respectively by a first and by a second face of the movable blade 21, limiting gas flows, between one fixed blade and the neighbouring movable blade thereof, perpendicular to the faces of the blades. According to an alternative embodiment, a fixed blade and a neighbouring movable blade may overlap partially at the axis 20, such as to improve continuity of the gas flow from the fixed blade to the movable blade. The second drive motor 17 is also electrically powered from outside the shared housing 12, and controlled by the electronic control unit 15, by means of power-supply wires and connections passing through the housing 12 via cable runs sealed against the gases handled by the compressor unit. Fixed blades are sometimes already present in a compressor-unit return channel. As the gas flow is already partially channeled by the fixed blades, the stresses exerted on the movable blades placed downstream of these fixed blades are reduced in relation to the stresses that would be exerted on the fixed or movable blades channeling the gas flow on their own. The movable blades can therefore be smaller than any fixed blades present. In an embodiment, the movable blades are shorter than the blades before them: thus, a greater part of the stresses is absorbed by the fixed blades, which are cheaper to dimension in terms of material costs, and the cost of making the movable blades can be reduced. The length of the blade refers to the dimension thereof in the direction the gas flows along the blade.

Figure 3A:
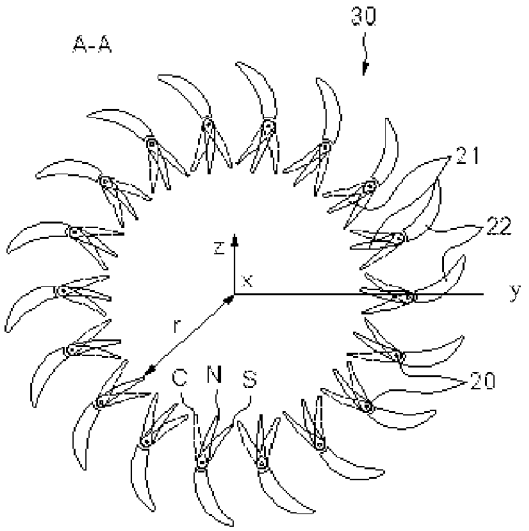
FIG. 3A is a partial cross section of the adjustment elements of the compressor unit in FIG. 2.

FIG. 3A is a cross section AA of the deflection device 30. FIG. 3A includes reference signs shared with the preceding figures, the same elements being indicated using the same reference signs. The axis x refers in particular to the geometric axis of the impeller 4, the axes y and z forming with the axis x an orthonormal reference point, such that the axis xy corresponds to the cross section in FIG. 2.

Figure 3B:
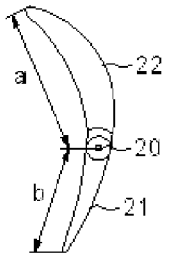
FIG. 3B is an isolated view of an element of FIG. 3A.

The deflection device 30 includes a set of pairs of fixed/movable blades 22-21 that are angularly equidistant about the axis x. According to an alternative embodiment, the blade pairs may form angularly equidistant groups without being equidistantly arranged as a whole. The geometry of each pair is identical, as shown at a larger scale in the detailed view in FIG. 3B, and each pair is located at the same distance r from the geometric axis x of the impeller 4. According to an alternative embodiment, the return channel 24 may include groups of blade pairs having different geometries, and/or including fixed blades not related to the movable blades and/or blades located at different distances from the axis x, the blade pattern of the return channel being however obtained by means of a periodic rotation of a group of reference blades about the axis x.

As shown in FIG. 3A, each movable blade 21 can turn about the axis 20 thereof between a first position "S", in which it accentuates the gas deflection determined by the upstream fixed blade 22 thereof, and a second position "C", in which it partially compensates for the gas deflection determined by the upstream fixed blade 22 thereof. Between the first position and the second position, the movable blade 21 passes through a neutral position "N" in which the faces thereof are substantially continuous with the faces of the upstream blade thereof. The profile of the upstream blade and of the downstream blade may be calculated such that, when the set of movable blades is in a position close to the neutral position "N", the tangential component of the speed of the gas coming from the return channel is substantially zero. The length "b" of the movable blade 21 in the direction of flow of the gas along the movable blade is generally less than the length "a" of the fixed blade in the direction of flow of the gases along the fixed blade. For example, the length b of the movable blade may be 0.2 to 1 times the length of the fixed blade, and is more particularly between 0.3 and 0.6 times the length of the fixed blade. In an embodiment, the length of the movable blade may be substantially half the length of the fixed blade.

Figure 4:
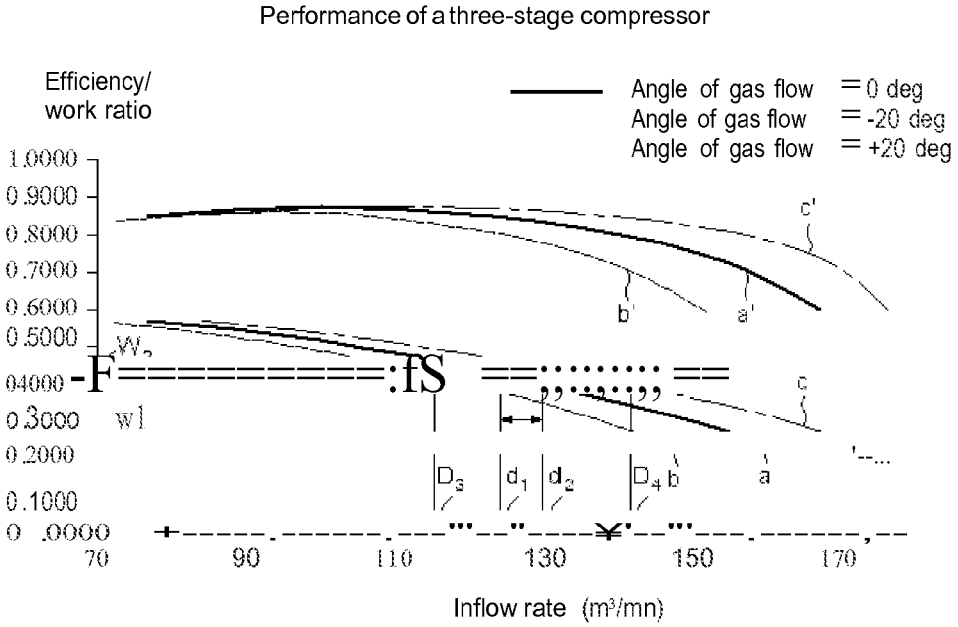
FIG. 4 is a graph showing the trend in the power and work done by the compressor unit as a function of the gas flow rate admitted, for different positions of the adjustment elements in FIG. 3A.

FIG. 4 shows firstly the trend of the work done by the compressor 25 (curves a, b, c) and secondly the efficiency trend (curves a', b', c') as a function of the flow rate admitted at the inlet of the compressor unit. When targeting a given working range [$w_1$, $w_2$] for example, the flow rate range [$d_1$, $d_2$], determined by curve a, that would be obtained if the return channel only contained fixed blades having the same overall geometry as the blade pairs 21-22, is extended to a flow rate range [$D_3$, $D_4$] by the new operating curves obtained for the different positions of the movable blades 21, covered by the extreme operating curves b and c.

Furthermore, since the motor 1 and the compression stage or stages incorporating the impellers 4, 4' are in the same housing 12 sealed against the gas handled, such that the whole interior is immersed in the gas handled, the inside of the compressor unit has no shaft-output seal between the rotor 2 of the drive motor and the driven shaft 3, and only has rotary joints subject to low pressure differences, for example labyrinth seals. This eliminates the risk of process gases leaking into the atmosphere. In an embodiment, in order to prevent ventilation leaks, the motor 1 is subject to the suction pressure of one of the compressor impellers. Circulating gas can also be provided for cooling purposes.

An embodiment of the invention can in particular be used for gas transfer stations, for which the pressure ratios between suction and discharge to be provided are relatively low, in particular less than 2, and for which the compressor units are more particularly single-stage or, generally, have less than three stages. Indeed, for this type of application, it is often desirable to have a relatively large range of flow rates so as to be able to offer low or high flow rates.

However, naturally, any other application in which a relatively large range of flow rates is desired can also be envisaged.

The invention is not limited to the example embodiments described, and may take the form of numerous alternative embodiments. The fixed blades could be replaced by a second movable blade portion, that is either moved by the same motor as the first movable blade portion 21, or by a separate motor. In this alternative embodiment, the two blades need not always be extensions of one another, depending on the positions of the upstream blade in particular. Two rotary blades or a single blade articulated in two movable portions are also possible.

At least some of the fixed blades could be surrounded simultaneously by movable blade portions located upstream of the fixed blades, and by movable blade portions located downstream of the fixed blades without thereby moving outside the scope of the invention.

The compressor unit according to embodiments of the invention enables the operating ranges of centrifugal compressor units to be widened cheaply. If the compressor unit is designed on the basis of an existing compressor unit that already has fixed blades in a centripetal gas-return channel, the cost of designing and making the improved compressor unit according to embodiments of the invention is even lower.

The invention claimed is:

1. A compressor unit comprising:

at least one first motor driving in rotation at least one impeller of a compression stage;

a diffuser at an outlet of the at least one impeller, wherein the diffuser is configured to centrifugally channel gases coming from the at least one impeller;

a centripetal return channel downstream of the diffuser, wherein the centripetal return channel comprises a group of blades, wherein the group of blades comprises at least one fixed blade and at least one movable blade portion movable by a control motor about an axis such that, when moved, can vary a tangential component of a speed of the gases coming from the centripetal return channel; and a shared housing, wherein the at least one first motor, the at least one impeller of a compression stage, the diffuser, the centripetal return channel, and the control motor are assembled in the shared housing sealed against the gas handled by the compressor unit.

2. The compressor unit according to claim 1, wherein the centripetal return channel comprises fixed blades, and the at least one movable blade portion is an extension of one of the fixed blades.

3. The compressor unit according to claim 2, wherein each of the at least one movable blade portion is an extension of a corresponding fixed blade of the fixed blades downstream of the corresponding fixed blade.

4. The compressor unit according to claim 3, wherein the movable blade portion is movable in rotation in relation to an axis substantially parallel to the geometric axis of the at least one impeller.

5. The compressor unit according to claim 3, wherein the centripetal return channel further comprises several movable blade portions that are configured to simultaneously adopt a neutral angular position for which the gases coming from the centripetal return channel have a substantially zero tangential speed component.

6. The compressor unit according to claim 2, wherein each of the fixed blades comprises a first movable blade portion of at least one movable blade portion that is an upstream extension of the fixed blade, and a second movable blade portion of at least one movable blade portion that is a downstream extension of the fixed blade.

7. The compressor unit according to claim 6, wherein the centripetal return channel further comprises several movable blade portions that are configured to simultaneously adopt a neutral angular position for which the gases coming from the centripetal return channel have a substantially zero tangential speed component.

8. The compressor unit according to claim 6, wherein the movable blade portion is movable in rotation in relation to an axis substantially parallel to the geometric axis of the at least one impeller.

9. The compressor unit according to claim 8, to simultaneously adopt a neutral angular position for which the gases coming from the centripetal return channel have a substantially zero tangential speed component.

10. The compressor unit according to claim 9, wherein each of the several movable blade portions can turn between two extreme positions on either side of the neutral angular position.

11. The compressor unit according to claim 10, wherein a first movable blade portion is configured to turn on either side of a first neutral angular position, and a second movable blade portion is configured to turn on either side of a second neutral angular position, the first and second movable blade portions being able to turn independently of one another and independently in relation to a neutral position.

12. The compressor unit according to claim 6, wherein a first movable blade portion is configured to turn on either side of a first neutral angular position, and a second movable blade portion is configured to turn on either side of a second neutral angular position, the two blades being able to turn independently of one another and independently in relation to a neutral position.

13. The compressor unit according to claim 2, wherein the movable blade portion is movable in rotation in relation to an axis substantially parallel to the geometric axis of the at least one impeller.

14. The compressor unit according to claim 2, wherein the centripetal return channel further comprises several movable blade portions that are configured to simultaneously adopt a neutral angular position for which the gases coming from the centripetal return channel have a substantially zero tangential speed component.

15. The compressor unit according to claim 1, wherein the movable blade portion is movable in rotation in relation to an axis substantially parallel to the geometric axis of the at least one impeller.

16. The compressor unit according to claim 1, wherein the centripetal return channel further comprises several movable blade portions that are configured to simultaneously adopt a neutral angular position for which the gases coming from the centripetal return channel have a substantially zero tangential speed component.

17. The compressor unit according to claim 16, wherein each of the several movable blade portions can turn between two extreme positions on either side of the neutral angular position.

18. The compressor unit according to claim 1, wherein an axial width of the at least one movable blade portion is substantially equal to the axial width of the centripetal return channel.

19. The compressor unit according to claim 1, wherein the centripetal return channel comprises several movable blade portions that can be moved by a single control motor.

20. The compressor unit according to claim 1, further comprising several centrifugal compression stages, wherein each of at least two of the centrifugal compression stages comprises one impeller, one diffuser, and one centripetal return channel comprising movable blade portions.

21. The compressor unit according to claim 1, wherein an adjustment member comprising a group of movable blades is interposed between an admission orifice and a first impeller of the at least one impeller.

22. The compressor unit according to claim 21, wherein the adjustment member is an aerodynamic element that is arranged upstream of the first impeller of the at least one impeller.

* * * * *